US005538827A

United States Patent [19]

Muramoto et al.

[11] Patent Number: 5,538,827

[45] Date of Patent: Jul. 23, 1996

[54] PHOTOSENSITIVE PRINTING MATERIAL

[75] Inventors: Hisaichi Muramoto, Hirakata; Kazunori Kanda, Yao; Yutaka Kanoi, Suita, all of Japan

[73] Assignee: Nippon Paint Co., Ltd., Osaka-fu, Japan

[21] Appl. No.: 313,338

[22] Filed: Sep. 27, 1994

[30] Foreign Application Priority Data

Sep. 30, 1993 [JP] Japan ..... 5-244798

[51] Int. Cl.[6] ..... G03G 5/04

[52] U.S. Cl. ..... 430/83; 430/96

[58] Field of Search ..... 430/83, 96

[56] References Cited

U.S. PATENT DOCUMENTS 4,296,190 10/1981 Hasegawa ..... 430/57

*Primary Examiner*—Kathleen Duda

*Attorney, Agent, or Firm*—Wenderoth, Lind & Ponack

[57] ABSTRACT

Disclosed is a photosensitive material for printing comprising a photoconductive layer containing a phthalocyanine compound and a binder resin provided on a conductive substrate. The binder resin is composed of one or more sorts of resins. At least one sort of the resin is a homopolymer of a radical-polymerizable monomer (I) of the formula:

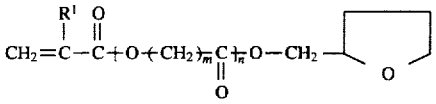

(I)

wherein $R^1$ is hydrogen or a methyl group, m is an integer of 2 to 5 and n is an integer of 0 to 10. An amount of the homopolymer is 0.01 to 50% by weight based on the total amount of the binder resin.

2 Claims, No Drawings

PHOTOSENSITIVE PRINTING MATERIAL

FIELD OF THE INVENTION

The present invention relates to a photosensitive material for printing comprising a photoconductive layer provided on a conductive substrate. More particularly, it relates to a photosensitive material for electrophotographic printing having high sensitivity in near infrared/visible range, which can also be applied for a laser platemaking system using long-wavelength semi-conductor laser (780 nm) as a light source.

BACKGROUND OF THE INVENTION

A photosensitive material comprising a photoconductive layer containing a phthalocyanine compound and a binder resin provided on a conductive substrate has been used in fields such as printing, etc. Particularly, in the field of printing, this material is subjected to corona charging, subjected to an image exposure using semi-conductor laser light having an oscillation wavelength at 780 nm as a light source to form an electrostatic latent image, and then a toner is bound thereon to visualize the latent image. By eluting the part other than the part on which the toner was adhered, a printing plate is formed.

This elution of the part other than the part on which the toner was adhered, i.e. a so-called development is conducted exclusively with an aqueous alkali solution. Therefore, it is necessary to impart alkali-solubility to the binder resin. Heretofore, it has been considered to be important to introduce a large amount of hydrophilic functional groups (e.g. hydroxyl group, acid anhydride group, carboxyl group, sulfonic group, etc.) so as to impart alkali-solubility to the binder resin. For example, in Japanese Laid-Open Patent Publication Nos. 2-210448 and 5-19514, there are described those in which a phthalocyanine compound, guanidine, etc. are dispersed in an alkali-soluble binder resin such as carboxylated polyvinyl acetate resin, styrene-maleic acid copolymer resin, etc. Further, in Japanese Laid-Open Patent Publication No. 4-212967, there are described those in which a phthalocyanine compound is dispersed in an alkali-soluble binder resin such as carboxyl-group containing acrylic resin, etc.

However, in any design of the binder resin, it is considered to be important to impart alkali-solubility, as well as improve dispersibility of phthalocyanine as a photoconductive substance. Otherwise, sufficient performances are not obtained in fundamental characteristics such as charging properties, etc. The photoconductive substance, particularly phthalocyanine has surface hydrophobic nature and, therefore, it can not be easily dispersed in a strong hydrophilic binder. Also, storage stability of a paint is inferior. Further, since the above hydrophilic functional group is absorbed on/adjacent to the surface of a phthalocyanine pigment, insulating properties of the photoconductive layer are insufficient, thereby affecting electrical characteristics (particularly, initial potential and dark decay at the time of corona charging).

Under these circumstances, the present inventors have studied intensively in order to solve the above problems, and the present invention has been accomplished.

SUMMARY OF THE INVENTION

That is, the main object of the present invention is to greatly improve dispersibility of the phthalocyanine compound in the binder resin, thereby improving electrical characteristics of the photoconductive layer.

This object as well as other objects and advantages of the present invention will become apparent to those skilled in the art from the following description.

That is, the present invention provides a photosensitive material for printing comprising a photoconductive layer containing a phthalocyanine compound and a binder resin provided on a conductive substrate, said binder resin being composed of one or more sorts of resins, at least one sort of said resin being a homopolymer of a radical-polymerizable monomer (I) of the formula:

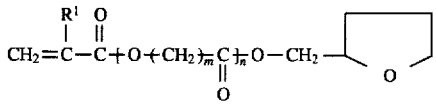

(I)

wherein $R^1$ is hydrogen or a methyl group, m is an integer of 2 to 5 and n is an integer of 0 to 10, an amount of said homopolymer being 0.01 to 50% by weight based on the total amount of the binder resin.

It is well known that tetrahydrofuran is a good dispersion medium for phthalocyanine. However, when tetrahydrofuran is formulated as a paint solvent, crystal transformation of phthalocyanine is accelerated. As a result, photoelectric characteristics of the dry coat (photoconductive layer) are likely to be deteriorated within a short period of time, thereby decreasing a storage period from manufacturing to coating of the paint. Further, since tetrahydrofuran has a low boiling point (65° C.), is is liable to be released into air from paint and is removed from the coat in a heating/drying step in an early stage, thereby causing poor dispersibility of phthalocyanine in the dry coat.

The present invention mitigates the above disadvantages. Firstly, by converting a (meth)acrylate monomer containing a tetrahydrofurfuryl group as a substituent into a polymer, adsorptivity onto the surface of a phthalocyanine powder is improved and progress in crystal transformation of phthalocyanine in the paint is inhibited.

Further, since the tetrahydrofurfuryl group is present as a polymeric pendant group, tetrahydrofuran is not released from the coat at the time of drying with heating. Therefore, dispersibility of phthalocyanine in the dry coat is not deteriorated. Further, it is assumed that insulating properties of the interior of the photosensitive layer may be improved because the homopolymer of the monomer (I) has a hydrophobic nature. As described above, by introducing the homopolymer of the monomer (I) into the binding agent, potential retention due to initial potential and dark decay at the time of corona charging is greatly improved.

As a result, an electrostatic image having large shade in charge density can be formed on the surface of the plate by irradiation of light from a semi-conductor laser. Therefore, adhesion of the toner is improved, thereby affording a clear visible image.

Further, when a photosensitive material having a large area such as printing plate for news printing is required, the photosensitive material maintains a sufficient surface potential even after a lapse of long time (several tens seconds to several minutes) required for scanning exposure. As a result, it becomes possible to form a clear visible image.

DETAILED DESCRIPTION OF THE INVENTION

The monomer of the formula (I) is a monomer containing a tetrahydrofuran ring at the molecular terminal end. The product of this monomer is known to the public. For example, it can be synthesized by the following method.

1st step: Ring opening addition reaction of lactone to (meth)acrylic acid

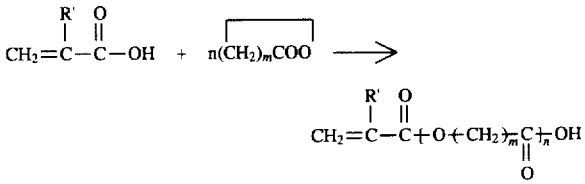

wherein M is hydrogen (2H) and metal, provided that m and n are as defined above and this step can be omitted when n is 0.

Examples of lactone used in this step include β-lactone (propiolactone, m is 2), γ-lactone (butyrolactone, m is 3), δ-lactone (δ-valerolactone, m is 4), ε-lactone (ε-caprolactone, m is 5) and the like.

2nd step: After the resulting compound is converted into an acid chloride, an ester bond is formed by a dehydrochlorination reaction with tetrahydrofurfuryl alcohol.

In both 1st and 2nd steps, the heating reaction is conducted while a vinyl group is protected in the presence of a radical polymerization inhibitor (e.g. hydroquinone methyl ether, etc.)

Examples of the monomer (I) include furfuryl (meth)acrylate, furfurylpolypropiolactone (meth)acrylate, furfurylpolybutyrolactone (meth)acrylate, furfurylpoly δ-valerolactone (meth)acrylate, furfurylpoly ε-caprolactone (meth)acrylate and the like.

This monomer is polymerized by a normal radical polymerization method to give a homopolymer. The polymerization may be conducted by a normal radical polymerization method (e.g. solution polymerization, bulk polymerization, emulsion polymerization, suspension polymerization, non-aqueous dispersion polymerization, etc.). The proper range of a molecular weight (number-average molecular weight) of the resulting resin is 3,000 to 1,000,000, preferably 10,000 to 300,000. When the number-average molecular weight is less than 3,000, it varies depending on the amount but the photosensitive resin layer becomes brittle, which results in insufficient plate wear. In the polymeric range where the number-average molecular weight is 1,000,000 or more, handling properties of the resulting resin solution are inferior because of its high viscosity, and a paint viscosity becomes too large to be suitable for coating.

The binder resin used in the present invention contains the other alkali-soluble resin. Examples of the resin having alkali-solubility which has hitherto been popular include copolymers of styrene, methacrylate, acrylate, vinyl acetate, vinyl benzoate, etc. with carboxylic acid-containing monomers (e.g. acrylic acid, methacrylic acid, itaconic acid, crotonic acid, maleic acid, fumaric acid, etc.) or dibasic acid monoester monomers, such as styrene/maleic acid copolymer, styrene/maleic acid monoester copolymer, (meth-)acrylic acid/(meth)acrylate copolymer, (meth)acrylic acid/acrylate/methacrylate copolymer, styrene/(meth)acrylic acid/(meth)acrylate copolymer, vinyl acetate/crotonic acid copolymer, vinyl benzoate/crotonic acid copolymer, vinyl acetate/crotonic acid/(meth)acrylate copolymer, etc., or copolymers of amide methacrylate, vinyl pyrrolidone, monomers containing phenolic hydroxyl group, sulfonic group, phosphoric group, etc. As a matter of course, the alkali-soluble resin C may contain the above monomer (I) as a copolymeric component. Further, binder resins described in Japanese Laid-Open Patent Publication Nos. 4-274428 and 4-258956 may also be used. Among the above alkali-soluble binder resins, that which is preferably used in the present invention is a resin having a glass transition temperature of not less than 40° C., an acid value of resin of 50 to 300 and a number-average molecular weight of not less than 10,000.

When the glass transition temperature is less than 40° C., the resin layer on the substrate becomes brittle, which results in insufficient plate wear at the time of printing. When the acid value of the resin is less than 50, alkali-solubility becomes inferior. On the other hand, when it exceeds 300, alkali-solubility of the resin layer becomes too strong. As a result, sand-etching is liable to be arise, which results in deterioration of image quality. Further, since the resin layer becomes brittle in case of an oligomer having a number-average molecular weight of less than 10,000, plate wear becomes insufficient.

In general, the phthalocyanine compound used in the present invention is a metallic phthalocyanine and a metal-free phthalocyanine represented by the formula (II):

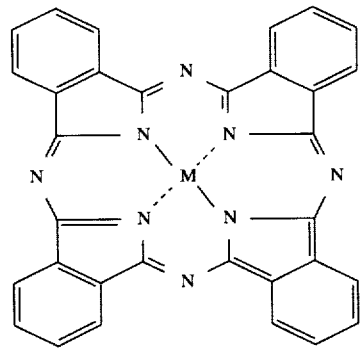

(II)

As the metallic phthalocyanine, there can be used those which have various crystal forms (e.g. α, β, ε, m, π, ρ, χ, etc.) or an amorphous form and are substituted with a halogen atom or not, examples of the metal including copper, magnesium, zinc, aluminum, vanadium, molybdenum, manganese, iron, cobalt, nickel, titanium or an oxide thereof. Further, as the metal-free phthalocyanine, those having a X-type crystal form are preferably used.

Various additives for improving charging characteristics or photosensitivity can also be formulated in a suitable amount in the photoconductive layer, in addition to the phthalocyanine compound as a charge generating substance. Examples thereof include electron acceptive compounds such as quinone compounds (e.g. anthraquinone, anzanthrone, pyranthrone, etc.), fluorenone compounds (e.g. trinitrofluorenone, tetranitrofluorenone, etc.), perinone compounds, perylene compounds, cyanine compounds, bisazo compounds, quinacridone compounds, acid anhydrides, etc.; electron donative compounds such as hydrazone compounds, triphenylmethane compounds, guanamine compounds, guanidine compounds, thiourea compounds, thiobarbituric acid derivatives, etc. In addition to the above compounds, it is possible to use known additives such as sensitizers, plasticizers and the like.

An amount of the homopolymer is 0.01 to 50% by weight, preferably 0.1 to 30% by weight based on the total amount of the binder resin. When the amount is less than 0.01% by weight, electrical characteristics (potential retention based on initial potential and dark decay) of the photosensitive composition prepared are not improved. On the other hand, when the amount exceeds 50% by weight, alkali-elution properties of the composition (coat) are deteriorated due to the lack of the alkali-soluble resin in the composition, and it is not preferred. As a formulation method of a homopolymer into a paint composition, there can be preferably used a method comprising dissolving a homopolymer in a good solvent, dispersing a phthalocyanine pigment in the resin solution and formulating the other alkali-soluble resin or additives. More preferably, the homopolymer is formed into a powder with drying and then the powdered homopolymer is mixed mechanically or bound mechanochemically with the phthalocyanine pigment, which causes a favorable effect in this invention.

Further, a weight ratio of the phthalocyanine to binder resin in the photoconductive layer is preferably 1/10 to 2/5. When the weight ratio is smaller than 1/10, photosensitivity of the composition is remarkably deteriorated and, therefore, it becomes difficult to obtain a clear toner image. On the other hand, when the weight ratio exceeds 2/5, a structural viscosity of the paint composition becomes high and, therefore, it becomes difficult to coat it. Further, the coat (photoconductive layer) after drying becomes brittle and plate wear at the time of use as a machine plate material is deteriorated. The photosensitive composition of the present invention may be produced by adding the above phthalocyanine compounds and, if necessary, electron acceptive compounds and/or electron donative compounds to a solution prepared by dissolving a binder resin in a suitable organic solvent to disperse the compounds uniformly using a normal dispersing equipment such as paint shaker, ball mill, sand mill, atriter, etc., applying the resulting mixed solution on a conductive substrate, followed by drying with heating. The application is normally conducted using a doctor blade, a bar coater (wire bar), a roll coater and the like.

Examples of the suitable solvent used for preparing the composition of the present invention include aromatic hydrocarbons such as benzene, toluene, xylene, etc.; ketones such as acetone, methyl ethyl ketone, methyl isobutyl ketone, etc.; ethers and cyclic ethers such as ethyl ether, tetrahydrofuran, 1,4-dioxane, etc.; esters such as ethyl acetate, butyl acetate, etc.; cellosolves (ethylene glycol monoalkyl ethers) such as methyl cellosolve, ethyl cellosolve, butyl cellosolve, etc.; or a mixture thereof.

The photosensitive resin plate of the present invention comprises a photosensitive layer of the above composition provided on a conductive substrate. The thickness of the photosensitive layer is 1 to 20 μm, preferably 2 to 10 μm, in case of a single-layer type.

When the thickness of the photosensitive layer is thin, deviating from the above proper range, a surface potential of the photosensitive material becomes low and only a small amount of a toner is adhered to the printing part after toner developing. Therefore, a perfect film of the toner image is not formed after fixing and a part containing no toner (e.g. fine cavity, pinhole, etc.) arises at the printing part. Accordingly, when a printing plate is produced by dissolving/removing the non-printing part of the photosensitive material with an alkali aqueous solution, the alkali aqueous solution penetrates through the cavity or pinhole of the toner image to partially dissolve/remove the photosensitive layer of the printing part, and it is not preferred.

When the thickness of the photosensitive layer is thick, deviating from the above proper range, a perfect film of the toner image can be formed on the photosensitive material. However, it takes a long time to dissolve the non-printing part of the photosensitive material with the alkali aqueous solution and the photosensitive layer of the printing part (e.g. fine line, halftone dot, etc.) is also removed by sand-etching, and it is not preferred.

After the above photosensitive resin composition is applied on the substrate, the coated substrate was dried to give a photosensitive layer. Regarding the drying condition, the heating temperature is 40° to 200° C., preferably 70° to 150° C. Further, the drying time varies depending upon the drying temperature, but is preferably about 1 to 30 minutes. When the drying is conducted at the temperature and time which are smaller than the above range, a large amount of the residual solvent remains in the photosensitive layer and, therefore, corona charge properties as well as charge retention due to dark decay are deteriorated. Further, when the drying is conducted at the temperature and time which are larger than the above range, the photosensitive layer welds to the substrate due to high temperature, or the polymerization reaction due to a non-reacted functional group in the binder resin is accelerated, or change in crystal form of phthalocyanine arises, thereby causing deterioration of alkali-elution properties, deterioration of charging characteristics and photosensitivity and the like.

As the substrate of the printing plate of the present invention, for example, there can be used a metallic plate or foil of aluminum, a plastic film on which metals such as aluminum is coated or a paper which has been subjected to a conductive treatment. These are used after subjecting to a hydrophilization treatment. Among these substrates, an aluminum plate is suitably used.

As the method of the hydrophilization treatment on the surface of the aluminum plate, there can be used a known method such as sand dressing method, anodizing method and the like. Examples of the sand dressing method include mechanical roughening method, electrochemical roughening method, chemical surface selective dissolution method and the like. As the mechanical roughening method, there can be used a known method such as ball polishing method, brush polishing method, blast polishing method, buffing method and the like. Further, the electrochemical roughening method includes a method of polishing with applying an AC or DC voltage in an electrolyte solution of hydrochloric acid or nitric acid.

The aluminum plate which has been subjected to the above treatment is subjected to the anodizing treatment. As the electrolyte in the anodizing treatment, there can be used sulfuric acid, phosphoric acid, oxalic acid or a mixed acid thereof. The electrolyte and concentration of the electrolyte are suitably decided according to the kind of the electrolyte. The coating weight of the anodized film is 0.10 to 10 g/m$^2$, preferably 0.5 to 5.0 g/m$^2$. Further, there can also be used those which are subjected to an electrodeposition treatment using an aqueous alkali metal silicate salt solution after anodizing treatment, as the suitable substrate.

According to the present invention, since electrical characteristics of the photoconductive layer can be improved, the surface of the photoconductive layer maintains a high charge potential for a long period of time after corona charging. As a result, an electrostatic latent image having large shade in charge density can be obtained by irradiation of light from a semi-conductor laser. After toner binding, adhesion of the toner is improved and a clear visible image can be obtained. It is also possible to form a clear visible image on a photosensitive material having a large area such as printing plate for news printing whether the scanning exposure time is long or short. Further, a high-quality printed article can be obtained from an original printing plate thus improved.

EXAMPLES

The following Production Examples, Examples and Comparative Examples further illustrate the present invention in detail but are not to be construed to limit the scope thereof. In the Production Examples, Examples and Comparative Examples, all "parts" are by weight unless otherwise stated.

Production Example 1 (Synthetic Example 1 of binder resin)

To a 1 liter flask equipped with a stirrer, a Dimroth condenser (condenser) and a nitrogen introducing tube, 200 parts of ethyl cellosolve was charged in advance and heated to 85° C. Then, a solution prepared by mixing/dissolving 124.8 parts of isobutyl methacrylate, 13.8 parts of ethylhexyl methacrylate, 61.4 parts of methacrylic acid and 1.4 parts of a radical polymerization initiator V-59 [2,2'-azobis(2-methylbutyronitrile), manufactured by Wako Pure Chemical Industries, Ltd.] was added dropwise in the flask from a dropping funnel over 3 hours. Further, the mixture was heated for additional 3 hours to complete the solution polymerization. The resulting resin had a solid content of 50%, a number-average molecular weight of 20,000, a weight-average molecular weight of 65,000 and an acid value of 200.

Production Example 2 (Synthetic Example 2 of binder resin)

According to the same manner as that described in Production Example 1, 200 parts of ethyl cellosolve was charged in a 1 liter flask in advance and heated to 85° C., and then a solution prepared by mixing/dissolving 200 parts of tetrahydrofurfuryl methacrylate and 1.4 parts of a radical polymerization initiator V-59 was added dropwise in the flask from a dropping funnel over 3 hours. Further, the mixture was heated for additional 3 hours to complete the solution polymerization. The resulting resin had a solid content of 50%, a number-average molecular weight of 18,500 and a weight-average molecular weight of 62,000.

Production Example 3 (Synthetic Example 3 of binder resin)

According to the same manner as that described in Production Example 1, 200 parts of ethyl cellosolve was charged in a 1 liter flask in advance and heated to 85° C., and then a solution prepared by mixing/dissolving 200 parts of tetrahydrofurfuryl polypropiolactone methacrylate (Propiolactone (10 moles) adduct) and 1.4 parts of a radical polymerization initiator V-59 was added dropwise in the flask from a dropping funnel over 3 hours. Further, the mixture was heated for additional 3 hours to complete the solution polymerization. The resulting resin had a solid content of 50%, a number-average molecular weight of 18,000 and a weight-average molecular weight of 54,000.

Production Example 4 (Synthetic Example 4 of binder resin)

According to the same manner as that described in Production Example 1, 200 parts of ethyl cellosolve was charged in a 1 liter flask in advance and heated to 85° C., and then a solution prepared by mixing/dissolving 200 parts of tetrahydrofurfuryl poly ε-caprolactone acrylate (ε-caprolactone (2 moles) adduct) and 1.4 parts of a radical polymerization initiator V-59 was added dropwise in the flask from a dropping funnel over 3 hours. Further, the mixture was heated for additional 3 hours to complete the solution polymerization. The resulting resin had a solid content of 50%, a number-average molecular weight of 21,500 and a weight-average molecular weight of 68,000.

Production Example 5 (Synthetic Example 5 of binder resin)

To a 1 liter flask equipped with a stirrer, a Dimroth condenser (condenser) and a nitrogen introducing tube, 100 parts of deionized water was charged in advance and heated to 85° C. Then, a pre-emulsified solution of 100 parts of tetrahydrofurfuryl methacrylate, 1 part of an emulsifier, alkyl diphenyl ether disulfonate (Newcol 271 A, manufactured by Nihon Nyukazai Co., Ltd.) and 150 parts of deionized water, and 40 parts of a 2% aqueous solution of ammonium persulfate in deionized water were added dropwise over 2 hours, simultaneously. Then, the mixed solution was stirred with heating for additional one hour to give a synthetic resin emulsion having a solid content of 25% and an average particle size of 160 nm. About 100 g of a dry resin was obtained from the resin solution by means of a freeze-drying method. The resulting resin had a number-average molecular weight of 300,000 (according to GPC measurement).

Production Example 6 (Synthetic Example 6 of binder resin)

According to the same manner as that described in Production Example 1, 200 parts of ethyl cellosolve was charged in a 1 liter flask in advance and heated to 85° C., and then a solution prepared by mixing/dissolving 138.6 parts of tetrahydrofurfuryl methacrylate, 61.4 parts of methacrylic acid and 1.4 parts of a radical polymerization initiator V-59 was added dropwise in the flask from a dropping funnel over 3 hours. Further, the mixture was heated for additional 3 hours to complete the solution polymerization. The resulting resin had a solid content of 50%, a number-average molecular weight of 24,000, a weight-average molecular weight of 78,000 and an acid value of 200.

EXAMPLE 1

10 parts of Fastgen Blue 8120 (X-type metal-free phthalocyanine, manufactured by Dainippon Ink & Chemicals, Inc.), 90 parts of a resin solution synthesized in Production Example 1 and 10 parts of a resin solution synthesized in Production Example 2 were dispersed in 240 parts of a mixed solvent (xylene/ethyl cellosolve=2/1 (w/w)). Then, the mixture was charged in a vessel together with a suitable amount of glass beads to prepare a paint for photosensitive layer using a paint shaker (Red devil, manufactured by Aisin Co.). This paint was applied on an aluminum plate, of which surface was subjected to a hydrophilization treatment in advance, using a wire bar (bar coater), followed by drying at 100° C. for 25 minutes to prepare an electrographic lithographic printing plate having a photosensitive layer of 5 μm in film thickness. Charging characteristics and photosensitivity of the printing original plate were measured using a "paper analyzer EPA-8100" manufactured by Kawaguchi Denki Co., Ltd. A surface potential $V_0$ (V) of the photosensitive material immediately after application of a corona charge voltage of +6.0 KV and a surface potential $V_{60}$ (V) at the time at which 60 seconds have passed since the beginning of application of voltage were measured, and charge retention of the printing original plate (in case of dark state) was evaluated by the value of $V_{60}$ (V)/$V_0$ (V)(%). Monochromatic light of 780 nm obtained from white light through a filter was irradiated on the surface of the charged printing original plate to measure photosensitivity. A dose of exposure $E_{1/2}$ (Lux.Sec) which is necessary for the surface potential after exposure to be reduced to half of the initial surface potential and a residual potential $VR_{40}$ (V) at the time at which 40 seconds have passed since the beginning of exposure were measured by using a light intensity of 1.4 Lux.

Charging characteristics and photosensitivity of the printing original plate were evaluated according to these measurement values. The results are shown in Table 1.

EXAMPLE 2

10 parts of Fastgen Blue 8120 (X-type metal-free phthalocyanine, manufactured by Dainippon Ink & Chemicals, Inc.), 70 parts of a resin solution synthesized in Production Example 1 and 30 parts of a resin solution synthesized in Production Example 3 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

EXAMPLE 3

10 parts of Fastgen Blue 8120 (X-type metal-free phthalocyanine, manufactured by Dainippon Ink & Chemicals, Inc.), 96 parts of a resin solution synthesized in Production Example 1 and 4 parts of a resin solution synthesized in Production Example 4 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

EXAMPLE 4

10 parts of Fastgen Blue 8120 (X-type metal-free phthalocyanine, manufactured by Dainippon Ink & Chemicals, Inc.), 99 parts of a resin solution synthesized in Production Example 1 and 1 part of a dry resin synthesized in Production Example 5 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

EXAMPLE 5

10 parts of Fastgen Blue 8120 (X-type metal-free phthalocyanine, manufactured by Dainippon Ink & Chemicals, Inc.), 90 parts of a resin solution synthesized in Production Example 6 and 10 parts of a resin solution synthesized in Production Example 2 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

EXAMPLE 6

According to the same manner as that described in Example 1 except that 10 parts of octafluorooctakis(phenylthio)zinc phthalocyanine (manufactured by Nippon Shokubai Kagaku Kogyo Co., Ltd.), 10 parts of N,N'-diphenylthiourea, 10 parts of a pyranthrone orange 3-4-brom adduct, 90 parts of a resin solution synthesized in Production Example 1 and 10 parts of a resin solution synthesized in Production Example 2 were dispersed in 350 parts of a mixed solvent described in Example 1 and the corona charge voltage was changed to −6.0 KV, a paint was prepared. Then, charging characteristics and photosensitivity of the sample prepared by applying the resulting paint on a substrate and drying were measured. The results are also shown in Table 1.

EXAMPLE 7

10 parts of Fastgen Blue 8120 (X-type metal-free phthalocyanine, manufactured by Dainippon Ink & Chemicals, Inc.) and 1 part of a dry resin synthesized in Production Example 5 were firstly combined with stirring by means of a machanochemical method and then the mixture was dispersed in 99 parts of a resin solution synthesized in Production Example 1 and 240 parts of a mixed solvent. Then, charging characteristics and photosensitivity of the sample prepared by applying the resulting paint on a substrate and drying were measured. The results are also shown in Table 1.

COMPARATIVE EXAMPLE 1

10 parts of Fastgen Blue 8120 (X-type metal-free phthalocyanine, manufactured by Dainippon Ink & Chemicals, Inc.) and 100 parts of a resin solution synthesized in Production Example 1 were dispersed in 240 parts of a mixed solvent described in Example 1. Then, according to the same manner as that described in Example 1, paint was prepared and charging characteristics and photosensitivity of the sample prepared by applying the paint on a substrate and drying were measured. The results are also shown in Table 1.

COMPARATIVE EXAMPLE 2

10 parts of Fastgen Blue 8120 (X-type metal-free phthalocyanine, manufactured by Dainippon Ink & Chemicals, Inc.), 90 parts of a resin solution synthesized in Production Example 1 and 10 parts of a resin solution synthesized in Production Example 6 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

COMPARATIVE EXAMPLE 3

10 parts of Fastgen Blue 8120 (X-type metal-free phthalocyanine, manufactured by Dainippon Ink & Chemicals, Inc.) and 100 parts of a resin solution synthesized in Production Example 6 were dispersed in 240 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

COMPARATIVE EXAMPLE 4

10 parts of octafluoro-octakis(phenylthio)zinc phthalocyanine (manufactured by Nippon Shokubai Kagaku Kogyo Co., Ltd.), 10 parts of N,N'-diphenylthiourea, 10 parts of a pyranthrone orange 3-4-brom adduct and 100 parts of a resin solution synthesized in Production Example 1 were dispersed in 340 parts of a mixed solvent described in Example 1. Then, according to the same manner as that described in Example 1, a paint was prepared and charging characteristics and photosensitivity of the sample prepared by applying the paint on a substrate and drying were measured. The results are also shown in Table 1.

TABLE 1

| | $V_0$ (V) | $V_{10}$ (V) | $V_{50}/V_0$ (%) | E½ (Lux · Sec) | $VR_{40}$ (V) |
|---|---|---|---|---|---|
| Example 1 | 125 | 112 | 90.0 | 0.31 | 0 |
| Example 2 | 131 | 118 | 89.5 | 0.34 | 0 |
| Example 3 | 126 | 112 | 88.9 | 0.30 | 0 |
| Example 4 | 125 | 111 | 89.1 | 0.29 | 0 |
| Example 5 | 130 | 115 | 88.8 | 0.32 | 0 |
| Example 6 | −340 | −242 | 71.3 | 0.61 | −2 |
| Example 7 | 145 | 132 | 91.0 | 0.29 | 0 |
| Comparative Example 1 | 97 | 74 | 76.3 | 0.30 | 0 |
| Comparative Example 2 | 85 | 62 | 72.5 | 0.35 | 0 |
| Comparative Example 3 | 96 | 74 | 77.0 | 0.32 | 0 |
| Comparative Example 4 | −290 | −215 | 60.0 | 0.60 | −2 |

EXAMPLE 8

By using a scanning exposure type platemaking machine "1440EZ plate setter" (manufactured by Print Wear Co., U.S.A.) equipped with a semi-conductor laser having a wavelength of 780 nm as a light source, and a liquid developer, a clear toner image was formed on a printing original plate prepared in Example 1 by operations such as charging, exposure, liquid developing and fixing.

Thereafter, a photosensitive layer of the non-printing part on which no toner was adhered was dissolved/removed with an alkali developing solution (developer for 1440EZ, manufactured by Print Wear Co., U.S.A.) and was subjected to a protective treatment with a gum solution to prepare a lithographic printing plate wherein the toner image was remained as the printing part.

The respective printing plates thus obtained were attached to a portable offset printing machine, Hamadastar 700CDX manufactured by Hamada Insatsu Kikai Seizosho Co., Ltd. to print on a fine-quality paper with commercially available ink. As a result, one hundred thousand copies could be printed satisfactorily without causing scumming of the non-printed part by using any printing plate.

What is claimed is:

1. A photosensitive material for printing comprising a photoconductive layer provided on a conductive substrate, said photoconductive layer comprising (1) a phthalocyanine compound and (2) a binder resin comprising (a) an alkali-soluble resin and (b) a resin which is a homopolymer of a radical-polymerizable monomer (I) of the formula:

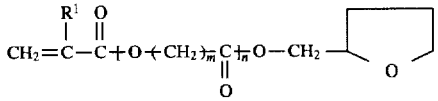

wherein $R^1$ is hydrogen or a methyl group, m is an integer of 2 to 5 and n is an integer of 0 to 10, an amount of said homopolymer being 0.01 to 50% by weight based on the total amount of the binder resin.

2. The photosensitive material according to claim 1, wherein the photoconductive layer further comprises an electron acceptive compound an electron donative compound or both said compounds.

* * * * *